US010550451B2

(12) United States Patent
Takeda et al.

(10) Patent No.: US 10,550,451 B2
(45) Date of Patent: Feb. 4, 2020

(54) NI-BASED ALLOY PIPE OR TUBE FOR NUCLEAR POWER

(71) Applicant: Nippon Steel & Sumitomo Metal Corporation, Tokyo (JP)

(72) Inventors: Kiyoko Takeda, Nishinomiya (JP); Shoji Kinomura, Chiba (JP)

(73) Assignee: Nippon Steel Corporation, Tokyo (JP)

( * ) Notice: Subject to any disclaimer, the term of this patent is extended or adjusted under 35 U.S.C. 154(b) by 142 days.

(21) Appl. No.: 15/739,631

(22) PCT Filed: Jun. 21, 2016

(86) PCT No.: PCT/JP2016/068366
§ 371 (c)(1),
(2) Date: Dec. 22, 2017

(87) PCT Pub. No.: WO2016/208569
PCT Pub. Date: Dec. 29, 2016

(65) Prior Publication Data

US 2018/0163285 A1 Jun. 14, 2018

(30) Foreign Application Priority Data

Jun. 26, 2015 (JP) ..... 2015-129008

(51) Int. Cl.
*C22C 19/05* (2006.01)
*G21D 1/00* (2006.01)
(Continued)

(52) U.S. Cl.
CPC ..... *C22C 19/055* (2013.01); *C22C 19/05* (2013.01); *C22C 19/053* (2013.01); *G21D 1/00* (2013.01); *C22F 1/00* (2013.01); *C22F 1/10* (2013.01)

(58) Field of Classification Search
CPC ..... C22C 19/05; C22C 19/053; C22C 19/055; C22F 1/00; C22F 1/10; G21D 1/00
(Continued)

(56) References Cited

U.S. PATENT DOCUMENTS 4,798,632 A * 1/1989 Yonezawa ..... C22C 19/058 148/410
5,378,427 A * 1/1995 Otsuka ..... C22C 30/00 148/909
8,246,766 B2 * 8/2012 Yokoyama ..... B21C 23/08 148/428

FOREIGN PATENT DOCUMENTS

CN 1639368 A 7/2005
JP S60053108 B2 11/1985
(Continued)

OTHER PUBLICATIONS

NPL: Machine translation of JP08239739A, Sep. 1996 (Year: 1996).*
(Continued)

*Primary Examiner* — Jie Yang
(74) *Attorney, Agent, or Firm* — Banner & Witcoff, Ltd.

(57) ABSTRACT

An object of the present invention is to provide an Ni-based alloy pipe or tube for nuclear power with reduced rate of SCC crack propagation. The Ni-based alloy pipe or tube for nuclear power according to the present invention is an Ni-based alloy pipe or tube having a wall thickness of 15 to 55 mm, having a chemical composition of, in mass %: 0.010 to 0.025% C; 0.10 to 0.50% Si; 0.01 to 0.50% Mn; up to 0.030% P; up to 0.002% S; 52.5 to 65.0% Ni; 20.0 to 35.0% Cr; 0.03 to 0.30% Mo; up to 0.018% Co; up to 0.015% Sn; 0.005 to 0.050% N; 0 to 0.300% Ti; 0 to 0.200% Nb; 0 to 0.300% Ta; 0% or more and less than 0.03% Zr; and the balance being Fe and impurities, wherein the Ni-based alloy pipe or tube has a microstructure being an austenite single
(Continued)

phase, and the chemical composition satisfies the following equation, Eq. (1):

$$-0.0020 \leq [N]/14-\{[Ti]/47.9+[Nb]/92.9+[Ta]/180.9+[Zr]/91.2\} \leq 0.0015 \quad \text{Eq. (1).}$$

For the element symbols in Eq. (1), the contents of the corresponding elements in mass % are substituted.

13 Claims, 4 Drawing Sheets

(51) Int. Cl.
*C22F 1/10* (2006.01)
*C22F 1/00* (2006.01)

(58) Field of Classification Search
USPC ..... 148/410
See application file for complete search history.

(56) References Cited

FOREIGN PATENT DOCUMENTS

| | | | | |
|---|---|---|---|---|
| JP | S60245773 | A | | 12/1985 |
| JP | 08239739 | A | * | 9/1996 |
| JP | 2554048 | B2 | | 11/1996 |
| JP | H10121170 | A | | 5/1998 |
| JP | 4433230 | B2 | | 3/2010 |
| JP | 2011121088 | A | | 6/2011 |

OTHER PUBLICATIONS

English Abstract & Family List corresponding to CN Publication No. 1639368A, published Jul. 13, 2005.
Yonezawa, T. et al, Effects of Metallurgical Factors on Stress Corrosion Cracking of Ni-base Alloys in High Temperature Water, 1988 JAIF International Conference on Water Chemsty in Nuclear Power Plant, Apr. 1988.

* cited by examiner

NI-BASED ALLOY PIPE OR TUBE FOR NUCLEAR POWER

RELATED APPLICATION DATA

This application is a National Stage Application under 35 U.S.C. 371 of co-pending PCT application number PCT/JP2016/068366 designating the United States and filed Jun. 21, 2016; which claims the benefit of JP application number 2015-129008 and filed Jun. 26, 2015 each of which are hereby incorporated by reference in their entireties.

TECHNICAL FIELD

The present invention relates to an Ni-based alloy pipe or tube for nuclear power, and more particularly, to an Ni-based alloy pipe or tube for nuclear power having a wall thickness of 15 to 55 mm.

BACKGROUND ART

The number of light-water reactors beyond 40 years of operation has increased, raising awareness of the problem of degradation over time of structural members. One type of degradation over time is stress-corrosion cracking (hereinafter referred to as SCC). SCC occurs when three factors, i.e. material, environment and stress, act simultaneously.

In the pressure boundary of a light-water reactor, Alloy 600 (15Cr-70Ni—Fe) or Alloy 690 (30Cr-60Ni—Fe) are used at positions that require particularly good SCC resistance. Alloy 690 has been commercialized as a material that improves Alloy 600 in terms of SCC initiation, where one of its features is that it has been subjected to a special heat treatment that intentionally precipitates $M_{23}C_6$ on grain boundaries and resolves Cr-depleted layers.

An example special heat treatment is described in Yonezawa et al., "Effects of Metallurgical Factors on Stress Corrosion Cracking of Ni-Base Alloys in High Temperature Water", Proceedings of JAIF International Conference on Water Chemistry in Nuclear Power Plants, volume 2 (1988), pp. 490-495.

Various methods to improve the SCC resistance of these alloys have been disclosed. Japanese Patent No. 2554048 discloses a high-strength Ni-based alloy having at least one of a γ' phase and γ" phase in the γ base and providing a microstructure in which $M_{23}C_6$ has precipitated with priority in a semi-continuous manner on crystal grain boundaries to improve SCC resistance. Japanese Patent No. 1329632 and JP Sho60 (1985)-245773 A each disclose an Ni-based alloy where a heating temperature and a heating time after cold rolling are specified to improve SCC resistance. Japanese Patent No. 4433230 discloses a high-strength Ni-based alloy pipe or tube for nuclear power where the crystal grain size is made fine by Ti- or Nb-containing carbonitrides.

DISCLOSURE OF THE INVENTION

The phenomenon of SCC can be divided into "crack initiation" and "crack propagation". Most of the above-listed documents are directed to reducing the initiation of SCC, and focus on controlling $M_{23}C_6$ that precipitates on grain boundaries.

The differences between SCC initiation and SCC crack propagation will be discussed below. As discussed above, Ni-based alloy pipes or tubes with good corrosion resistance, such as Alloy 690, are used for structural members of the pressure boundary of a light-water reactor. Different positions at which they are used require different corrosion resistances.

For example, a heat transfer tube of a steam generator (hereinafter referred to as SG tube) of a pressurized-water reactor (hereinafter referred to as PWR) has a small diameter and a small wall thickness (with an outer diameter of about 20 mm and a wall thickness of about 1 mm), where about 3000 to 6000 tubes are bundled together to form a steam generator. Since an SG tube has a small wall thickness, if SCC is produced, the ends of the tube are immediately sealed and its use is halted. Accordingly, a thin-wall pipe or tube such as an SG tube is required to have a low SCC initiation susceptibility.

On the other hand, a PWR control rod drive mechanism (CRDM) nozzle tube has a large diameter and a large wall thickness (with an outer diameter of about 100 to 185 mm and an inner diameter of about 50 to 75 mm); thus, even if SCC is initiated, the remaining life can be evaluated based on the rate of SCC crack propagation. Thus, safe operation can be achieved by regularly replacing a CRDM nozzle tube during a periodic inspection. Accordingly, a thick-wall pipe or tube such as a CRDM nozzle tube is required to have a low rate of SCC crack propagation.

U.S. Pat. Nos. 2,554,048, 1,329,632 and JP Sho60 (1985)-245773 A deal with SCC initiation susceptibility, and do not sufficiently discuss SCC crack propagation.

U.S. Pat. No. 4,433,230 describes a technique to increase the strength of an Ni-based alloy pipe or tube by providing fine dispersed particles of Ti- or Nb-containing carbonitrides. U.S. Pat. No. 4,433,230 does not discuss the influence of carbonitrides on SCC crack propagation.

An object of the present invention is to provide an Ni-based alloy pipe or tube for nuclear power with reduced rate of SCC crack propagation.

The Ni-based alloy pipe or tube for nuclear power according to an embodiment of the present invention is an Ni-based alloy pipe or tube for nuclear power having a wall thickness of 15 to 55 mm, having a chemical composition of, in mass %: 0.010 to 0.025% C; 0.10 to 0.50% Si; 0.01 to 0.50% Mn; up to 0.030% P; up to 0.002% S; 52.5 to 65.0% Ni; 20.0 to 35.0% Cr; 0.03 to 0.30% Mo; up to 0.018% Co; up to 0.015% Sn; 0.005 to 0.050% N; 0 to 0.300% Ti; 0 to 0.200% Nb; 0 to 0.300% Ta; 0% or more and less than 0.03% Zr; and the balance being Fe and impurities, wherein the Ni-based alloy pipe or tube has a microstructure being an austenite single phase, and the chemical composition satisfies the following equation, Eq. (1):

$$-0.0020 \leq [N]/14-\{[Ti]/47.9+[Nb]/92.9+[Ta]/180.9+[Zr]/91.2\} \leq 0.0015 \quad \text{Eq. (1).}$$

For the element symbols in Eq. (1), the contents of the corresponding elements in mass % are substituted.

The present invention provides an Ni-based alloy pipe or tube for nuclear power with reduced rate of SCC crack propagation.

EMBODIMENTS FOR CARRYING OUT THE INVENTION

The present inventors conducted various studies and experiments about the behavior of SCC crack propagation in an Ni-based alloy pipe or tube for nuclear power, and obtained the following findings.

(a) Ti, Nb etc. are added to Ni-based alloys to reduce the decrease in hot workability due to the presence of N. However, current steel-making techniques can reduce the amount of N to 50 ppm or less, and thus can reduce the amounts of added N-fixing elements such as Ti, Nb, Ta and Zr compared with conventional art. However, reducing N excessively means increased costs, and it is thus realistic to set a lower limit at 50 ppm.

Figure 1:
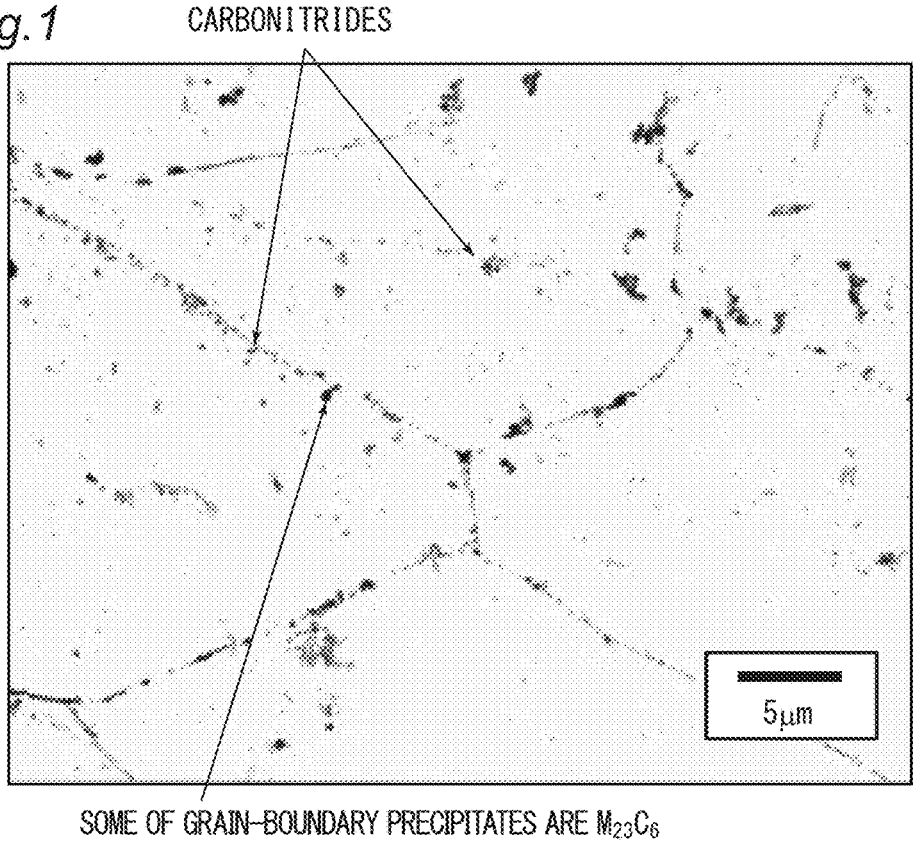
FIG. 1 shows a transmission electron microscopic image of an Ni-based alloy pipe or tube.
Figure 2:
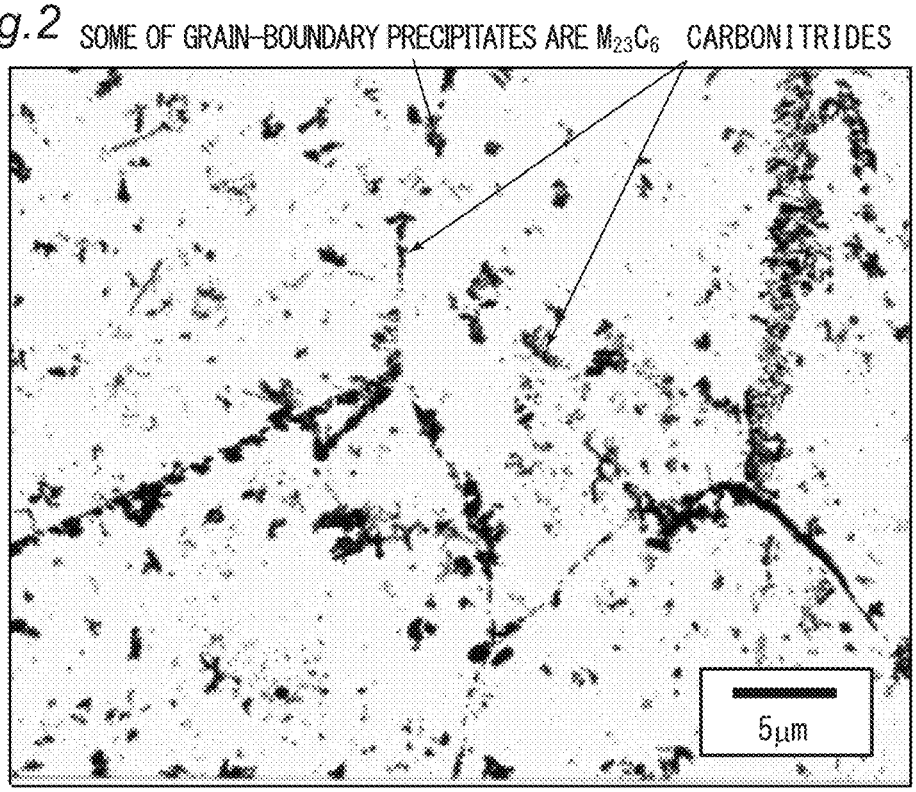
FIG. 2 shows a transmission electron microscopic image of the Ni-based alloy pipe or tube.

(b) FIGS. 1 and 2 each show a transmission electron microscopic (TEM) image of an Ni-based alloy. Carbonitrides are present both in crystal grains and along crystal grain boundaries. Carbonitrides precipitate at high temperatures during solidification of the material, and grow during the subsequent hot working step without being dissolved.

The inventors further investigated into the relationship between the precipitates that have precipitated on grain boundaries (hereinafter referred to as grain-boundary precipitates) and the rate of SCC crack propagation. As discussed above, carbonitrides precipitate during solidification, and thus are present not only in grains but also along grain boundaries. Further, in a material that has been subjected to the above-discussed special heat treatment, $M_{23}C_6$ is present on grain boundaries. In view of this, the inventors prepared the following four types of material and evaluated the rate of SCC crack propagation in a PWR primary simulating coolant:

[A] material as processed by solution treatment that has small amounts of precipitated carbonitrides;

[B] material as processed by solution treatment that has large amounts of precipitated carbonitrides;

[C] material [A] that has been subjected to the special heat treatment; and

[D] material [B] that has been subjected to the special heat treatment.

From these evaluations, the inventors found that the rate of SCC crack propagation is at the smallest for [A], and then increases in the order [B]-[C]-[D]. From this, the inventors further obtained the following findings.

(c) grain-boundary precipitates promote SCC crack propagation. This is presumably because grain-boundary precipitates weaken the bonding strength at grain boundaries. Accordingly, to reduce the rate of SCC crack propagation, it is effective to prevent precipitation of grain-boundary precipitates.

(d) Grain-boundary $M_{23}C_6$ that has been precipitated by the special heat treatment improves the SCC initiation susceptibility, but is not effective in preventing SCC crack propagation. This is presumably because of the following reason: during SCC initiation, the influence of stress is lower than during SCC crack propagation, and thus $M_{23}C_6$ in which Cr has concentrated prevents the progress of corrosion. On the other hand, during SCC crack propagation, the influence of stress is high and thus $M_{23}C_6$ works as foreign matter on grain boundaries and weakens the bonding strength of grain boundaries.

(e) The precipitation of grain-boundary precipitates may be prevented by omitting the special heat treatment. However, when one also considers SCC initiation susceptibility, it is not desirable to omit the special heat treatment. If the process presupposes performing the special heat treatment, it is effective to control components relating to the formation of carbonitrides to reduce grain-boundary precipitates.

Further, materials [A] and [B] above were subjected to cold working at 20% and the rate of SCC crack propagation was evaluated. For [A], the rate of SCC crack propagation did not change significantly regardless of whether cold working was performed or not. On the other hand, for [B], cold working increased the rate of SCC crack propagation by 50 times. In this experiment, the Vickers hardness in grains of [B] was about 1.3 times that in grains of [A]. From this result, the inventors further obtained the following findings.

(f) performing cold working on a material with large amounts of carbonitrides in grains promotes SCC crack propagation. This is presumably because distortions tend to accumulate in grains due to the pinning effect of carbonitrides, increasing the difference between the strength in grains and the strength on grain boundaries.

The present invention was made based on findings (a) to (f) provided above. An Ni-based alloy pipe or tube for nuclear power according to an embodiment of the present invention will now be described in detail.

The Ni-based alloy pipe or tube for nuclear power according to the present embodiment has the chemical composition described below. In the following description, "%" in the content of an element means mass percentage.

C: 0.010 to 0.025%

Carbon (C) is used to deoxidize steel and provide sufficient strength. If the C content is lower than 0.010%, a strength required from a structural member is not provided. If the C content exceeds 0.025%, this increases carbides precipitated on grain boundaries, increasing the rate of SCC crack propagation. In view of this, the C content should be in the range of 0.010 to 0.025%. The lower limit of C content is preferably 0.015%. The upper limit of C content is preferably 0.023%.

Si: 0.10 to 0.50%

Silicon (Si) is used for deoxidation. Deoxidation is insufficient if the Si content is lower than 0.10%. On the other hand, if the Si content exceeds 0.50%, this promotes the production of inclusions. In view of this, the Si content should be in the range of 0.10 to 0.50%. The lower limit of Si content is preferably 0.15%. The upper limit of Si content is preferably 0.30%.

Mn: 0.01 to 0.50%

Manganese (Mn) is effective at deoxidation and in stabilizing the austenite phase. These effects are not sufficiently present if the Mn content is lower than 0.01%. If the Mn content exceeds 0.50%, this decreases the index of cleanliness of the alloy. Mn forms sulfides and produce non-metal inclusions. Non-metal inclusions concentrate during welding, decreasing the corrosion resistance of the alloy. In view of this, the Mn content should be in the range of 0.01 to 0.50%. The lower limit of Mn content is preferably 0.10%. The upper limit of Mn content is preferably 0.40%.

P: up to 0.030%

Phosphorus (P) is an impurity. If the P content exceeds 0.030%, this causes embrittlement due to segregation in weld heat-affected zones, increasing crack susceptibility. In view of this, the P content should be 0.030% or lower. More preferably, the P content should be 0.020% or lower.

S: up to 0.002%

Sulfur (S) is an impurity. If the S content exceeds 0.002%, this causes embrittlement due to segregation in weld heat-affected zones, increasing crack susceptibility. In view of this, the S content should be 0.002% or lower. More preferably, the S content should be 0.0010% or lower.

Ni: 52.5 to 65.0%

Nickel (Ni) is effective in providing a sufficient corrosion resistance of the alloy. To reduce the rate of SCC crack propagation in a high-temperature, high-pressure water environment, the Ni content needs to be 52.5% or higher. On the other hand, to provide stability of the austenite phase and taking account of its interaction with other elements such as Cr and Mn, the upper limit of Ni content should be 65.0%. In view of this, the Ni content should be in the range of 52.5 to 65.0%. The lower limit of Ni content is preferably 55.0%, and more preferably 58.0%. The upper limit of Ni content is preferably 62.0%, and more preferably 61.0%.

Cr: 20.0 to 35.0%

Chromium (Cr) is effective in providing sufficient corrosion resistance of the alloy. To reduce the rate of SCC crack propagation in a high-temperature, high-pressure water environment, the Cr content needs to be 20.0% or higher. However, if the Cr content exceeds 35.0%, it forms Cr nitrides, decreasing the hot workability of the alloy. In view of this, the Cr content should be in the range of 20.0 to 35.0. The lower limit of Cr content is preferably 25.0%, and more preferably 28.0%. The upper limit of Cr content is preferably 33.0%, and more preferably 31.0%.

Mo: 0.03 to 0.30%

Molybdenum (Mo) prevents diffusion of Cr along grain boundaries, and thus is effective in preventing precipitation of $M_{23}C_6$ which promotes SCC crack propagation. This effect is not sufficiently present if the Mo content is lower than 0.03%. On the other hand, Mo in an alloy having a high Cr content causes a Laves phase to precipitate on grain boundaries, increasing the rate of SCC crack propagation. In view of this, the Mo content should be in the range of 0.03 to 0.30%. The lower limit of Mo content is preferably 0.05%, and more preferably 0.08%. The upper limit of Mo content is preferably 0.25%, and more preferably 0.20%.

Co: up to 0.018%

Cobalt (Co) is an impurity. Co elutes from an alloy surface that is in contact with the primary coolant in the nuclear reactor and, when activated, is converted to $^{60}Co$, which has a long half-life. In view of this, the Co content should be 0.018% or lower. The Co content is preferably 0.015% or lower.

Sn: up to 0.015%

Tin (Sn) is an impurity. If the Sn content exceeds 0.015%, this causes embrittlement due to segregation in weld heat-affected zones, increasing crack susceptibility. In view of this, the Sn content should be 0.015% or lower. The Sn content is preferably 0.010% or lower, and more preferably 0.008% or lower.

N: 0.005 to 0.050%

Nitrogen (N) combines with Ti and C to form carbonitrides. If the N content exceeds 0.050%, excessive amounts of carbonitrides are produced, increasing the rate of SCC crack propagation. On the other hand, N is used to improve the strength of the alloy. Further, reducing N excessively means increased costs; thus, the inventors determined that the lower limit should be 0.005%. In view of this, the N content should be in the range of 0.005 to 0.050%. The lower limit of N content is preferably 0.008%. The upper limit of N content is preferably 0.025%.

The balance of the chemical composition of the Ni-based alloy pipe or tube for nuclear power according to the present embodiment is Fe and impurities. Impurity as used herein means an element originating from ore or scrap used as raw material for the alloy or an element that has entered from the environment or the like during the manufacturing process.

In the chemical composition of the Ni-based alloy pipe or tube for nuclear power according to the present embodiment, some of the Fe may be replaced by one or two or more elements selected from the group consisting of Ti, Nb, Ta and Zr. Each of Ti, Nb, Ta and Zr fixes N to improve the hot workability of the alloy. Ti, Nb, Ta and Zr are optional elements. That is, the chemical composition of the Ni-based alloy pipe or tube for nuclear power according to the present embodiment may lack one or more or all of Ti, Nb, Ta and Zr.

Ti: 0 to 0.300%

Titanium (Ti) is effective in advantageously preventing hot workability from decreasing, and in providing sufficient strength of the alloy. These effects are present if small amounts of Ti are contained. On the other hand, if the Ti content exceeds 0.300%, excess amounts of carbonitrides are produced, increasing the rate of SCC crack propagation in a high-temperature, high-pressure hydrogen environment. In view of this, the Ti content should be in the range of 0 to 0.300%. The lower limit of Ti content is preferably 0.005%, and more preferably 0.0100%, and yet more preferably 0.012%. The upper limit of Ti content is preferably 0.250%, and more preferably 0.200%.

Nb: 0 to 0.200%

Niobium (Nb) is effective in advantageously preventing hot workability from decreasing, and in providing sufficient strength of the alloy. These effects are present if small amounts of Nb are contained. On the other hand, if the Nb content exceeds 0.200%, excess amounts of carbonitrides are produced, increasing the rate of SCC crack propagation in a high-temperature, high-pressure hydrogen environment. In view of this, the Nb content should be in the range of 0 to 0.200%. The lower limit of Nb content is preferably 0.001%. The upper limit of Nb content is preferably 0.100%.

Ta: 0 to 0.300%

Tantalum (Ta) is effective in advantageously preventing hot workability from decreasing, and in providing sufficient strength of the alloy. These effects are present if small amounts of Ta are contained. On the other hand, if the Ta content exceeds 0.300%, excess amounts of carbonitrides are produced, increasing the rate of SCC crack propagation in a high-temperature, high-pressure hydrogen environment. In view of this, the Ta content should be in the range of 0 to 0.300%. The lower limit of Ta content is preferably 0.001%. The upper limit of Ta content is preferably 0.250%, and more preferably 0.150%.

Zr: 0% or higher and lower than 0.03%

Zirconium (Zr) is effective in advantageously preventing hot workability from decreasing, and in providing sufficient strength of the alloy. These effects are present if small amounts of Zr are contained. On the other hand, since carbonitrides containing Zr precipitate at high rate during solidification, adding excess amounts may cause mixed grains (component segregation), decreasing corrosion resistance. If the Zr content is 0.03% or higher, excess amounts of carbonitrides are produced, increasing the rate of SCC crack propagation in a high-temperature, high-pressure hydrogen environment. In view of this, the Zr content is 0% or higher and lower than 0.03%. The lower limit of Zr content is preferably 0.001%. The upper limit of Zr content is preferably 0.02%.

The chemical composition of the Ni-based alloy pipe or tube for nuclear power according to the present embodiment satisfies the following equation, Eq. (1):

$$-0.0020 \leq [N]/14-\{[Ti]/47.9+[Nb]/92.9+[Ta]/180.9+[Zr]/91.2\} \leq 0.0015 \quad \text{Eq. (1).}$$

For the element symbols in Eq. (1), the contents of the corresponding elements in mass % are substituted.

Fn is defined as follows: Fn=[N]/14−{[Ti]/47.9+[Nb]/92.9+[Ta]/180.9+[Zr]/91.2. Smaller Fn values mean that more Ti, Nb, Ta and Zr are present relative to N. If the value of Fn is smaller than −0.0020, the amount of precipitated carbonitrides increases, increasing the rate of SCC crack propagation. On the other hand, if the value of Fn exceeds 0.0015, hot workability decreases. In view of this, the value of Fn should be in the range of −0.0020 to 0.0015. The lower limit of the value of Fn is preferably −0.0010. The upper limit of the value of Fn is preferably 0.0010.

[Microstructure]

The microstructure of the Ni-based alloy pipe or tube for nuclear power according to the present embodiment is an austenite single phase. More particularly, the microstructure of the Ni-based alloy pipe or tube for nuclear power according to the present embodiment is made up of an austenite phase, and the remainder is precipitates.

[Grain-Boundary Precipitates]

The Ni-based alloy pipe or tube for nuclear power according to the present embodiment has grain boundaries on which a plurality of precipitate particles have precipitated. In the Ni-based alloy pipe or tube for nuclear power according to the present embodiment, precipitates may be present within grains. A precipitate that has precipitated on a grain boundary will be hereinafter referred to as grain-boundary precipitate as distinct from a precipitate that has precipitated within a grain. A grain-boundary precipitate includes at least a carbonitride.

In the Ni-based alloy pipe or tube for nuclear power according to the present embodiment, grain-boundary precipitates preferably include both carbonitrides and $M_{23}C_6$. As $M_{23}C_6$ precipitates on grain boundaries and a Cr-depleted layer is resolved, the SCC initiation susceptibility is reduced.

The Ni-based alloy pipe or tube for nuclear power according to the present embodiment has no Cr-depleted layer. When $M_{23}C_6$ precipitates on grain boundaries, the SCC initiation susceptibility decreases, but a Cr-depleted layer may be produced around $M_{23}C_6$. The presence of a Cr-depleted layer reduces grain-boundary-corrosion resistance. More specifically, the rate of corrosion evaluated in accordance with ASTM A 262 C becomes higher than 1 mm/yr. On the other hand, if the rate of corrosion evaluated in accordance with ASTM A 262 C is not higher than 1 mm/yr, the pipe or tube can be considered to have no Cr-depleted layer.

As discussed below, the Ni-based alloy pipe or tube for nuclear power is subjected to the special heat treatment such that the grain-boundary precipitates include both carbonitrides and $M_{23}C_6$ and the Ni-based alloy pipe or tube for nuclear power has no Cr-depleted layer.

In the Ni-based alloy pipe or tube for nuclear power according to the present embodiment, it is preferable that the average of the major-axis length of grain-boundary precipitates (hereinafter referred to as average major-axis length) is 0.8 μm or smaller and the number of precipitate particles having a larger major-axis length than 0.8 μm (hereinafter referred to as rate of occurrence of coarse precipitate particles) is less than 3.0 per micrometer of grain boundary.

If the average major-axis length of grain-boundary precipitate particles exceeds 0.8 μm, the rate of SCC crack propagation increases significantly. Also, even if the average major-axis length of grain-boundary precipitate particles is 0.8 μm or smaller, the rate of SCC crack propagation significantly increases if the rate of occurrence of coarse precipitate particles is 3.0 or larger per micrometer of grain boundary.

The average major-axis length of grain-boundary precipitate particles and the rate of occurrence of coarse precipitate particles may be measured in the following manner.

A test specimen is taken in such a way that the circumferential cross section of the alloy pipe or tube (i.e. cross section perpendicular to the axial direction) provides an observation surface. The observation surface is buffed and etched. The etched observation surface is magnified by scanning electron microscopy (SEM) by 10,000 times so as to provide an image that contains a triple point of grain boundaries. The size of the field of vision may be 35 μm×75 μm, for example.

Figure 3:
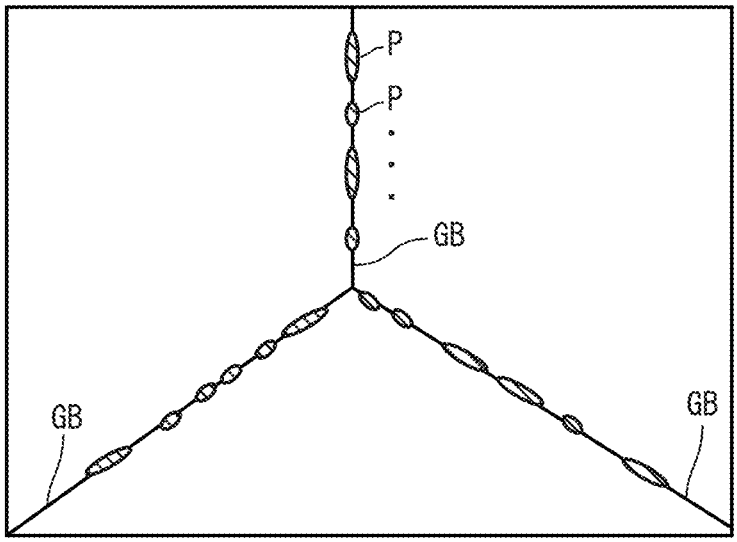
FIG. 3 shows a schematic microscopic image of the Ni-based alloy pipe or tube.

FIG. 3 shows a schematic SEM image of the alloy pipe or tube. In FIG. 3, GB indicates grain boundaries and P indicates grain-boundary precipitates. In FIG. 3, the precipitates that have precipitated within grains are not shown.

Figure 4:
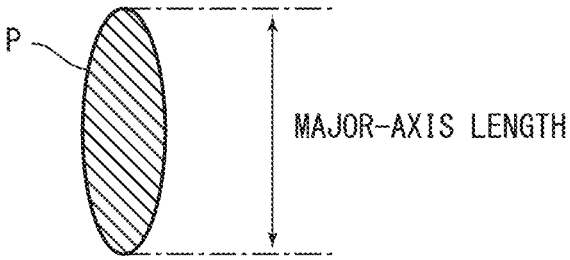
FIG. 4 is a schematic view of one grain-boundary precipitate particle.

FIG. 4 is a schematic view of one grain-boundary precipitate particle P. The grain-boundary precipitate particle P is flat-shaped. The major-axis length of the grain-boundary precipitate particle P is defined as the maximum distance between interfaces of the grain-boundary precipitate particle P.

Grain-boundary precipitate particles having a major-axis length of 0.1 μm or larger are observed in one field of vision. Grain-boundary precipitate particles having a major-axis length smaller than 0.1 μm are excluded because of the difficulty in determining whether they are actually grain-boundary precipitate particles. The average major-axis length in this field of vision is defined as the average of the major-axis lengths of grain-boundary precipitate particles having a major-axis length of 0.1 μm or larger. More specifically, the average major-axis length in this field of vision is defined as the sum of the major-axis lengths of grain-boundary precipitate particles having a major-axis length of 0.1 μm or larger divided by the number of the grain-boundary precipitate particles having a major-axis length of 0.1 μm or larger.

Next, the number of grain-boundary precipitate particles having a major-axis length of 0.8 μm or larger (hereinafter referred to as coarse precipitate particles) is counted in the same field of vision. The rate of occurrence of coarse precipitate particles in this field of vision is defined as the number of coarse precipitate particles divided by the length of the grain boundaries in this field of vision.

For example, if a grain-boundary precipitate particle having a major-axis length of 0.5 μm and a grain-boundary precipitate particle having a major-axis length of 2 μm are present along a length of 10 μm of grain boundary, the average major-axis length is 1.25 μm and the rate of occurrence of coarse precipitate particles per micrometer is 0.1.

Such measurement is conducted for 10 fields of vision, and the average grain size of grain-boundary precipitate particles and the rate of occurrence of coarse precipitate particles for the Ni-based alloy pipe or tube are defined as the average values for these 10 fields.

[Manufacture Method]

An example of the method of manufacturing the Ni-based alloy pipe or tube for nuclear power according to the present embodiment will be described below.

The Ni-based alloy having the above-described chemical composition is smelted and refined to produce an ingot. The ingot is hot forged to produce a billet. The billet is subjected to hot extrusion or further hot forging before producing a hollow shell. The hot extrusion may be the Ugine-Sejourne method, for example.

The produced hollow shell is subjected to solution treatment. More specifically, the hollow shell is soaked at 1000 to 1200° C. The holding time may be 15 minutes to 1 hour, for example.

Preferably, the hollow shell that has undergone solution treatment is subjected to the special heat treatment to cause $M_{23}C_6$ to precipitate. The special heat treatment causes $M_{23}C_6$ to precipitate on grain boundaries and recovers Cr-depleted zones. That is, in the Ni-based alloy pipe or tube for nuclear power that has undergone the special heat treatment, grain-boundary precipitates include both carbonitrides and $M_{23}C_6$ and has no Cr-depleted zone.

More specifically, the hollow shell is soaked at 690 to 720° C. If the soaking temperature is too low, the Cr-depleted zones are not sufficiently recovered and the amount of precipitated $M_{23}C_6$ is not sufficient, resulting in a poor intergranular corrosion resistance. If the soaking temperature is too high, $M_{23}C_6$ particles become coarse, increasing the rate of SCC crack propagation. The holding time is 5 to 15 hours. If the holding time is too short, the Cr-depleted zones are not sufficiently recovered and the amount of precipitated $M_{23}C_6$ is not sufficient, resulting in a poor intergranular corrosion resistance. If the holding time is too long, $M_{23}C_6$ particles become coarse, increasing the rate of SCC crack propagation.

The Ni-based alloy pipe or tube for nuclear power according to an embodiment of the present invention has been described. The present embodiment provides an Ni-based alloy pipe or tube for nuclear power with reduced rate of SCC crack propagation.

The Ni-based alloy pipe or tube for nuclear power according to the present embodiment may be suitably used as an alloy pipe or tube with a large wall thickness. More specifically, it may be suitably used as an alloy pipe or tube with a wall thickness of 15 to 55 mm. The Ni-based alloy pipe or tube for nuclear power according to the present embodiment preferably has a wall thickness of 15 to 38 mm.

Particularly, the Ni-based alloy pipe or tube for nuclear power according to the present embodiment is suitably used as an alloy pipe or tube with a large diameter and a large wall thickness. The Ni-based alloy pipe or tube for nuclear power according to the present embodiment preferably has an outer diameter of 100 to 180 mm and an inner diameter of 50 to 75 mm.

An embodiment of the present invention has been described. The above-described embodiment is merely an example for carrying out the present invention. Thus, the present invention is not limited to the above-described embodiment, and the above-described embodiment can be modified as appropriate without departing from the spirit of the present invention.

EXAMPLES

The present invention will now be described more specifically using examples. The present invention is not limited to these examples.

Ni-based alloys having the chemical compositions shown in Table 1 were smelted and refined by AOD and VOD, and were then subjected to secondary refinement by ESR under a condition of 400 kg/hr to produce Ni-based alloy ingots. "-" in the chemical compositions shown in Table 1 indicates that the content of the relevant element is at an impurity level. The column "Fn" in Table 1 provides values of Fn=[N]/14−{[Ti]/47.9+[Nb]/92.9+[Ta]/180.9+[Zr]/91.2}.

TABLE 1

| | Manufacture | Final heat | Chemical composition (in mass %, balance being Fe and impurities) | | | | | | | | | | | |
|---|---|---|---|---|---|---|---|---|---|---|---|---|---|---|
| Mark | method | treatment | C | Si | Mn | P | S | Ni | Cr | Mo | Co | Sn | Ti | Nb |
| Inv. Ex. 1 | A | special heat treatment | 0.018 | 0.23 | 0.19 | 0.015 | 0.0008 | 60.1 | 29.5 | 0.09 | 0.010 | 0.0001 | 0.048 | — |
| Inv. Ex. 2 | A | solution treatment | | | | | | | | | | | | |
| Inv. Ex. 3 | A | special heat treatment | 0.015 | 0.26 | 0.20 | 0.008 | 0.0010 | 59.5 | 29.7 | 0.09 | 0.008 | 0.0001 | 0.099 | — |
| Inv. Ex. 4 | A | special heat treatment | 0.020 | 0.20 | 0.21 | 0.006 | 0.0011 | 59.8 | 29.8 | 0.18 | 0.011 | 0.0001 | 0.151 | — |
| Inv. Ex. 5 | A | special heat treatment | 0.018 | 0.19 | 0.20 | 0.012 | 0.0010 | 59.5 | 30.4 | 0.12 | 0.010 | 0.0001 | 0.178 | — |
| Inv. Ex. 6 | A | special heat treatment | 0.016 | 0.18 | 0.19 | 0.024 | 0.0015 | 60.3 | 29.7 | 0.09 | 0.010 | 0.0002 | 0.032 | 0.008 |
| Inv. Ex. 7 | A | special heat treatment | 0.022 | 0.19 | 0.21 | 0.008 | 0.0010 | 60.4 | 29.6 | 0.11 | 0.011 | 0.0004 | — | 0.048 |
| Inv. Ex. 8 | B | special heat treatment | 0.023 | 0.25 | 0.21 | 0.008 | 0.0012 | 58.5 | 30.2 | 0.04 | 0.012 | 0.0001 | — | — |
| Inv. Ex. 9 | A | solution treatment | | | | | | | | | | | | |
| Inv. Ex. 10 | B | special heat treatment | 0.022 | 0.26 | 0.24 | 0.009 | 0.0008 | 59.5 | 29.8 | 0.18 | 0.012 | 0.0001 | 0.012 | — |
| Inv. Ex. 11 | B | special heat treatment | 0.020 | 0.21 | 0.23 | 0.022 | 0.0008 | 59.8 | 29.9 | 0.08 | 0.012 | 0.0002 | 0.005 | 0.186 |
| Inv. Ex. 12 | B | special heat treatment | 0.021 | 0.22 | 0.24 | 0.014 | 0.0010 | 60.1 | 29.2 | 0.24 | 0.011 | 0.0001 | 0.012 | — |
| Comp. Ex. 1 | A | special heat treatment | 0.019 | 0.24 | 0.25 | 0.009 | 0.0009 | 59.5 | 30.4 | 0.01 | 0.010 | 0.0001 | 0.210 | 0.002 |
| Comp. Ex. 2 | A | special heat treatment | 0.021 | 0.25 | 0.20 | 0.012 | 0.0011 | 60.3 | 29.7 | 0.02 | 0.011 | 0.0002 | — | 0.445 |

TABLE 1-continued

| | | | | | | | | | | | | | | |
|---|---|---|---|---|---|---|---|---|---|---|---|---|---|---|
| Comp. Ex. 3 | B | special heat treatment | 0.020 | 0.23 | 0.18 | 0.015 | 0.0008 | 59.9 | 29.8 | 0.22 | 0.008 | 0.0001 | 0.080 | — |
| Comp. Ex. 4 | B | special heat treatment | 0.018 | 0.18 | 0.22 | 0.014 | 0.0010 | 60.2 | 29.6 | 0.09 | 0.012 | 0.0003 | 0.150 | — |
| Comp. Ex. 5 | B | special heat treatment | 0.023 | 0.21 | 0.20 | 0.017 | 0.0010 | 59.9 | 29.4 | 0.38 | 0.010 | 0.0001 | 0.196 | — |
| Comp. Ex. 6 | A | special heat treatment | 0.023 | 0.18 | 0.16 | 0.014 | 0.0008 | 59.4 | 29.9 | 0.08 | 0.010 | 0.0002 | 0.196 | 0.200 |
| Comp. Ex. 7 | A | special heat treatment | 0.018 | 0.16 | 0.21 | 0.008 | 0.0012 | 61.3 | 29.5 | 0.01 | 0.009 | 0.0004 | 0.178 | — |
| Comp. Ex. 8 | A | sensitization | 0.018 | 0.23 | 0.19 | 0.015 | 0.0008 | 60.1 | 29.5 | 0.09 | 0.010 | 0.0001 | 0.048 | — |
| Comp. Ex. 9 | B | sensitization | 0.023 | 0.25 | 0.21 | 0.008 | 0.0012 | 58.5 | 30.2 | 0.04 | 0.012 | 0.0001 | — | — |
| Comp. Ex. 10 | B | sensitization | 0.022 | 0.26 | 0.24 | 0.009 | 0.0008 | 59.5 | 29.8 | 0.18 | 0.012 | 0.0001 | 0.012 | — |

| | Chemical composition (in mass %, balance being Fe and impurities | | | | | Grain-boundary precipitate | | |
|---|---|---|---|---|---|---|---|---|
| Mark | Ta | Zr | N | Fn | ASTM A262C | Average major-axis length (μm) | Occurence (number of particles/μm) | Rate of SCC crack propagation (mm/s) |
| Inv. Ex. 1 | — | — | 0.016 | 0.0001 | passed | 0.2 | 2.7 | 4.3E−11 |
| Inv. Ex. 2 | | | | | passed | 0.1 | 0.1 | <1.0E−12 |
| Inv. Ex. 3 | — | — | 0.021 | −0.0006 | passed | 0.3 | 2.5 | 7.8E−11 |
| Inv. Ex. 4 | — | — | 0.023 | −0.0015 | passed | 0.7 | 1.2 | 2.2E−10 |
| Inv. Ex. 5 | — | — | 0.024 | −0.0020 | passed | 0.8 | 1.1 | 7.5E−10 |
| Inv. Ex. 6 | 0.152 | — | 0.010 | −0.0009 | passed | 0.5 | 1.4 | 5.2E−10 |
| Inv. Ex. 7 | 0.098 | 0.028 | 0.010 | −0.0006 | passed | 0.8 | 1.0 | 2.4E−10 |
| Inv. Ex. 8 | | — | 0.008 | 0.0006 | passed | 0.2 | 2.8 | 1.4E−10 |
| Inv. Ex. 9 | | | | | passed | 0.1 | 0.2 | <1.0E−12 |
| Inv. Ex. 10 | — | — | 0.014 | 0.0007 | paased | 0.3 | 2.2 | 8.3E−10 |
| Inv. Ex. 11 | — | — | 0.010 | −0.0014 | passed | 0.4 | 1.4 | 8.9E−10 |
| Inv. Ex. 12 | 0.295 | — | 0.010 | −0.0012 | passed | 0.6 | 1.2 | 8.6E−10 |
| Comp. Ex. 1 | — | — | 0.030 | −0.0023 | passed | 0.9 | 1.2 | 8.6E−9 |
| Comp. Ex. 2 | — | — | 0.030 | −0.0026 | passed | 1.1 | 1.1 | 1.2E−7 |
| Comp. Ex. 3 | 0.350 | — | 0.020 | −0.0022 | passed | 0.9 | 2.0 | 5.6E−7 |
| Comp. Ex. 4 | — | 0.250 | 0.020 | −0.0044 | passed | 0.6 | 3.0 | 4.3E−7 |
| Comp. Ex. 5 | — | — | 0.020 | −0.0027 | passed | 1.0 | 0.9 | 4.3E−9 |
| Comp. Ex. 6 | 0.300 | 0.200 | 0.008 | −0.0096 | passed | 1.8 | 2.8 | 8.0E−6 |
| Comp. Ex. 7 | — | — | 0.024 | −0.0020 | passed | 0.9 | 3.4 | 7.4E−9 |
| Comp. Ex. 8 | — | — | 0.016 | 0.0001 | not passed | 0.1 | 0.4 | — |
| Comp. Ex. 9 | — | — | 0.008 | 0.0006 | not passed | 0.1 | 0.6 | — |
| Comp. Ex. 10 | — | — | 0.014 | 0.0007 | not passed | 0.1 | 0.7 | — |

Some of the billets were heated to 1150° C. to perform hot extrusion and produce Ni-based alloy tubes with an outer diameter of 130 mm and a wall thickness 32 mm (Manufacture Method A).

The other billets were heated to 1150° C. and forged to have an outer diameter of 180 mm, and the central portions were machined for hole-making to produce Ni-based alloy tubes with an outer diameter of 180 mm and inner diameter of 70 mm (Manufacture Method B).

The type of heat treatment performed on each Ni-based alloy tubes is indicated in the column "Final heat treatment" in Table 1. The Ni-based alloy tubes with "special heat treatment" in this column were subjected to solution treatment at 1060° C. and then subjected to the special heat treatment, where they were held at 715° C. for 600 minutes. The Ni-based alloy tubes with "solution treatment" in this column were only subjected to solution treatment at 1060° C. The Ni-based alloy tubes with "sensitization" in this column were subjected to solution treatment at 1060° C. and were then subjected to sensitization, where they were held at 715° C. for 180 minutes.

The average major-axis length of grain-boundary precipitate particles and the rate of occurrence of coarse precipitate particles for each Ni-based alloy tube after the heat treatment was measured in accordance with the method described in connection with the embodiment.

The grain-boundary-corrosion resistance of each Ni-based alloy tube after the heat treatment was evaluated in accordance with ASTM A 262 C. An example with a rate of corrosion of 1 mm/yr or lower was determined to have passed the test, and an example with a rate exceeding 1 mm/yr was determined to have not passed the test. The results are shown in Table 1 above.

A plate with a thickness of 26 mm, a width of 50 mm and a length of 200 mm was taken from each Ni-based alloy tube after the heat treatment, and was subjected to cold rolling with a reduction in area of 30% to produce a compact-tension test specimen (hereinafter referred to as CT test specimen) with a thickness of 0.7 inches. A load was applied repeatedly to each CT test specimen in the atmosphere to introduce a fatigue pre-crack with a total length of 1 mm. Further, it was immersed in a PWR primary simulated coolant (at 360° C. with 500 ppm B, 2 ppm Li, with a dissolved oxygen concentration of 5 ppb or lower and a dissolved hydrogen concentration of 30 cc/kg $H_2O$), and loads were applied that had different stress-intensity factors with an upper limit of 24 MPa√m and a lower limit of 17.5 MPa√m, where the stress-intensity factor was changed by a triangular wave with a frequency of 0.1 Hz, to introduce fatigue a pre-crack in the environment. Then, SCC crack propagation testing was conducted where a constant load with a stress-intensity factor of 25 MPa√m was applied to the test specimen, which was held this way for 3000 hours.

Figure 5:
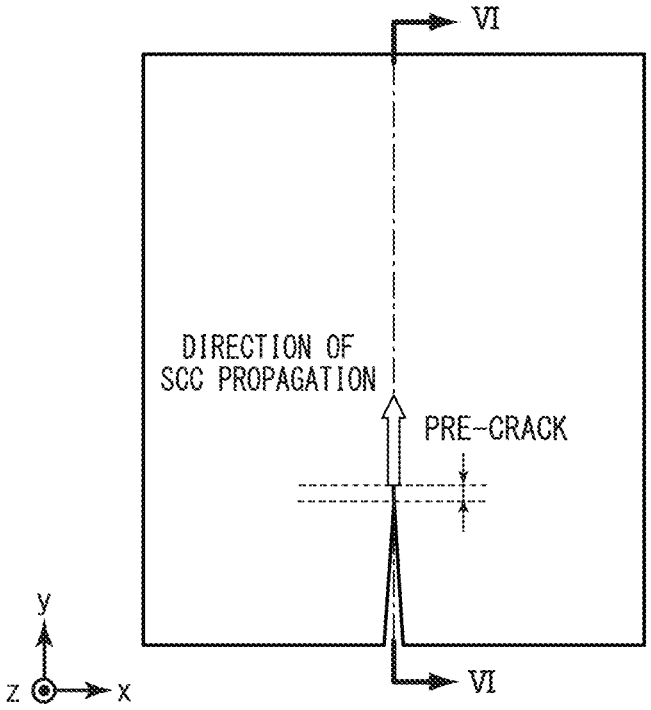
FIG. 5 is s schematic plan view of a compact-tension test specimen.
Figure 6:
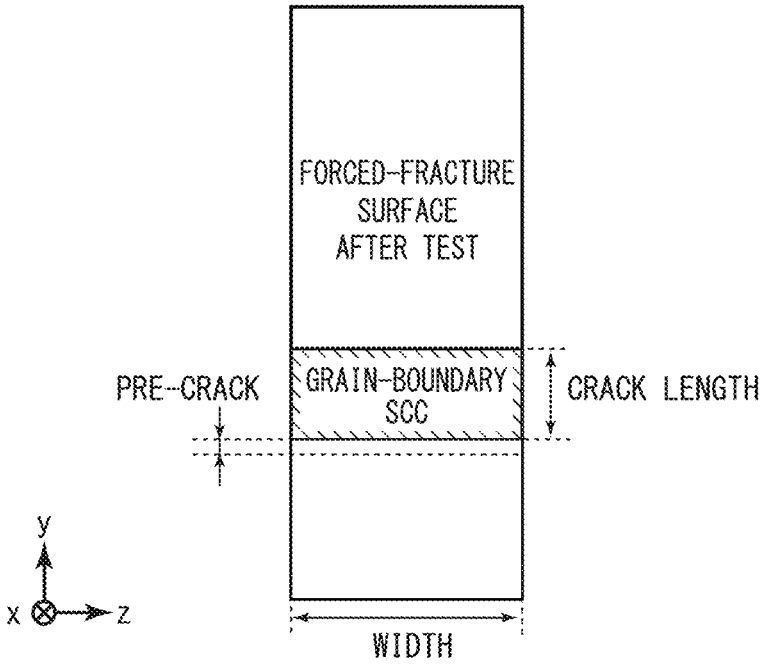
FIG. 6 is a schematic cross-sectional view of the compact-tension test specimen.

FIGS. 5 and 6 illustrate how to evaluate the rate of SCC crack propagation. FIG. 5 is s schematic plan view of a CT test specimen after the test. After the test, in the atmosphere, the CT test specimen was forced to break along line VI-VI in FIG. 5. FIG. 6 is a schematic view of the fracture surface.

The rate of crack propagation of grain-boundary SCC propagated by SCC was evaluated by observing the fracture surface. The rate was determined by dividing the area of grain-boundary SCC by the width of the propagation of the crack in an SEM image of the fracture surface to calculate the average crack length and then dividing it by the testing time to provide a rate (mm/s). An example with a rate of SCC crack propagation of $1\times10^{-9}$ mm/s or lower was determined to be good, while an example with a rate exceeding $1\times10-^{9}$ mm/s was determined to be poor.

The results are shown in Table 1 above. Referring to Table 1, in each of the Ni-based alloy tubes of Inventive Examples 1 to 12, the contents of the elements were appropriate and the chemical composition satisfied Eq. (1). In each of the Ni-based alloy tubes of Inventive Examples 1 to 12, the average major-axis length of grain-boundary precipitate particles was 0.8 μm or smaller and the rate of occurrence of coarse precipitate particles per micrometer of grain boundary was less than 3.0. In each of the Ni-based alloy tubes of Inventive Examples 1 to 12, the rate of SCC crack propagation was $1\times10^{-9}$ mm/s or lower.

The Ni-based alloy tubes of Inventive Examples 2 and 9 were not subjected to the special heat treatment and thus no $M_{23}C_6$ precipitated on grain boundaries. Although these Ni-based alloy tubes had very low rates of SCC crack propagation, they are estimated to be somewhat inferior in terms of SCC initiation susceptibility.

In each of the Ni-based alloy tubes of Comparative Examples 1 and 2, the rate of SCC crack propagation was higher than $1\times10^{-9}$ mm/s. This is presumably because the average major-axis length of grain-boundary precipitate particles was larger than 0.8 μm. The average major-axis length was large presumably because the too low Mo content caused a large amount of $M_{23}C_6$ to precipitate or because Eq. (1) was not satisfied and thus large amounts of carbonitrides precipitated.

In the Ni-based alloy tubes of Comparative Example 3, the rate of SCC crack propagation was higher than $1\times10^{-9}$ mm/s. This is presumably because the average major-axis length of grain-boundary precipitate particles was larger than 0.8 μm. The average major-axis length was large presumably because Eq. (1) was not satisfied and thus large amounts of carbonitrides precipitated.

In the Ni-based alloy tube of Comparative Example 4, the rate of SCC crack propagation was higher than $1\times10^{-9}$ mm/s. This is presumably because the rate of occurrence of coarse precipitate particles per micrometer of grain boundary was 3.0 or more. The rate of occurrence of coarse precipitate particles was high presumably because Eq. (1) was not satisfied and thus large amounts of carbonitrides precipitated.

In the Ni-based alloy tube of Comparative Example 5, the rate of SCC crack propagation was higher than $1\times10^{-9}$ mm/s. This is presumably because the average major-axis length of grain-boundary precipitate particles was larger than 0.8 μm. The average major-axis length was large presumably because the too high Mo content caused a large amount of Laves phase to precipitate on grain boundaries, or because Eq. (1) was not satisfied and thus large amounts of carbonitrides precipitated.

In the Ni-based alloy tube of Comparative Example 6, the rate of SCC crack propagation was higher than $1\times10^{-9}$ mm/s. This is presumably because the average major-axis length of grain-boundary precipitate particles was larger than 0.8 μm. The average major-axis length was large presumably because Eq. (1) was not satisfied and thus large amounts of carbonitrides precipitated.

In the Ni-based alloy tube of Comparative Example 7, the rate of SCC crack propagation was higher than $1\times10^{-9}$ mm/s. This is presumably because the average major-axis length of grain-boundary precipitate particles was larger than 0.8 μm, or because the rate of occurrence of coarse precipitate particles per micrometer of grain boundary was 3.0 or more. These conditions were produced presumably because the too low Mo content caused a large amount of $M_{23}C_6$ to precipitate.

The Ni-based alloy tubes of Comparative Examples 8 to 10 were the same as the Ni-based alloy tubes of Inventive Examples 1, 8 and 10 except that the special heat treatment was replaced by sensitization. In each of these Ni-based alloy tubes, the average major-axis length of grain-boundary precipitate particles was smaller than 0.8 μm and the rate of occurrence was low. However, the sensitization produced Cr-depleted layers, resulting in a poor grain-boundary corrosion resistance. This demonstrates that the resolution of Cr-depleted layers by the special heat treatment is effective.

Figure 7:
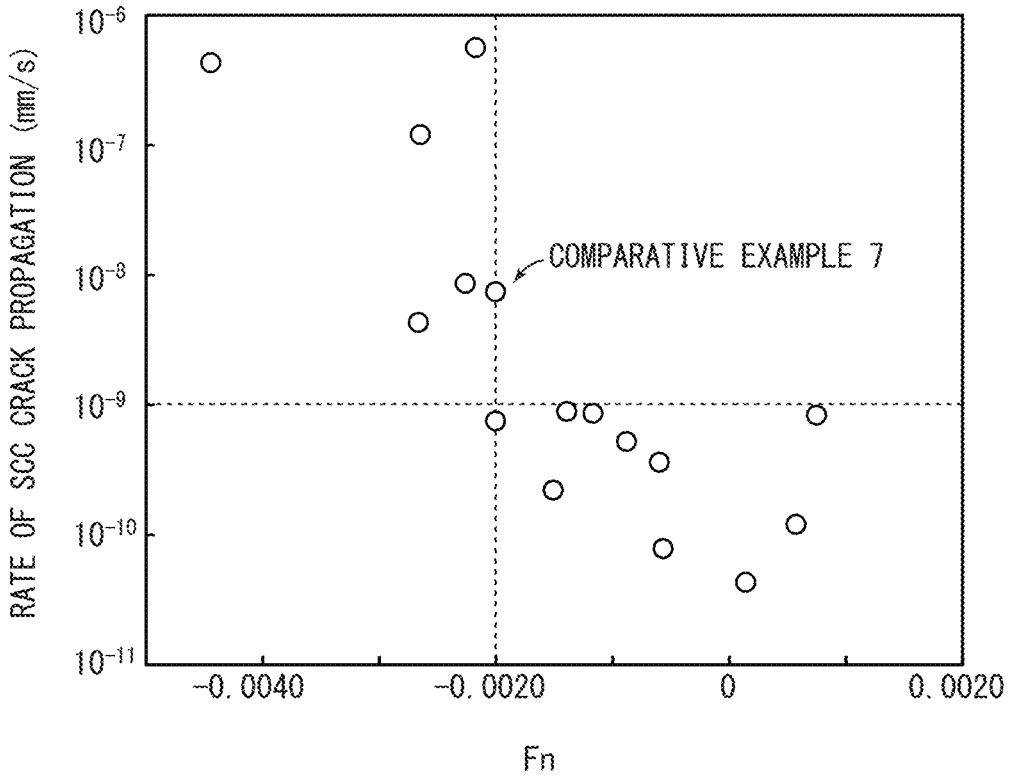
FIG. 7 is a scatter diagram showing the relationship between the value of Fn and the rate of SCC crack propagation.

FIG. 7 is a scatter diagram showing the relationship between the value of Fn and the rate of SCC crack propagation. As shown in FIG. 7, the rate of SCC crack propagation is $1\times10^{-9}$ mm/s or lower if the value of Fn is −0.0020 or larger.

INDUSTRIAL APPLICABILITY

The present invention can be suitably used in an Ni-based alloy pipe or tube for nuclear power used in a high-temperature, high-pressure water, such as a CRDM nozzle tube or a stub tube for a boiling-water reactor (BWR).

The invention claimed is:

1. An Ni-based alloy pipe or tube for nuclear power having a wall thickness of 15 to 55 mm, having a chemical composition of, in mass %:

0.010 to 0.025% C;
0.10 to 0.50% Si;
0.01 to 0.50% Mn;
up to 0.030% P;
up to 0.002% S;
52.5 to 65.0% Ni;
20.0 to 33.0% Cr;
0.03 to 0.25% Mo;
up to 0.018% Co;
up to 0.015% Sn;
0.005 to 0.050% N;
0 to 0.300% Ti;
0 to 0.200% Nb;
0 to 0.300% Ta;
0% or more and less than 0.03% Zr; and
the balance being Fe and impurities,
wherein the Ni-based alloy pipe or tube has a microstructure being an austenite single phase, and
the chemical composition satisfies the following equation, Eq. (1):

$$-0.0020\leq[N]/14-\{[Ti]/47.9+[Nb]/92.9+[Ta]/180.9+[Zr]/91.2\}\leq0.0015 \quad \text{Eq. (1),}$$

wherein, for the element symbols in Eq. (1), the contents of the corresponding elements in mass % are substituted.

2. The Ni-based alloy pipe or tube for nuclear power according to claim 1, wherein a rate of corrosion evaluated in accordance with ASTM A 262 C is 1 mm/yr or lower.

3. The Ni-based alloy pipe or tube for nuclear power according to claim 1, wherein the chemical composition includes one or two or more elements selected from the group consisting of, in mass %:

0.005 to 0.300% Ti;

0.001 to 0.200% Nb;

0.001 to 0.300% Ta; and not less than 0.001% and less than 0.03% Zr.

4. The Ni-based alloy pipe or tube for nuclear power according to claim 3, wherein a rate of corrosion evaluated in accordance with ASTM A 262 C is 1 mm/yr or lower.

5. The Ni-based alloy pipe or tube for nuclear power according to claim 1, wherein the alloy pipe or tube has been subjected to a solution heat treatment and a second heat treatment following the solution heat treatment, wherein the second heat treatment is performed at 690 to 720° C. for 5 to 15 hours.

6. The Ni-based alloy pipe or tube for nuclear power according to claim 1, wherein:

the Ni-based alloy pipe or tube for nuclear power has a grain boundary with a plurality of grain-boundary precipitate particles precipitated thereon;

an average of major-axis lengths of the plurality of grain-boundary precipitate particles is 0.8 μm or smaller; and a number of ones of the plurality of grain-boundary precipitate particles having a major-axis length of 0.8 μm or larger per micrometer of the grain boundary is less than 3.0.

7. The Ni-based alloy pipe or tube for nuclear power according to claim 6, wherein the grain-boundary precipitate particles includes both a carbonitride and $M_{23}C_6$, and has no Cr-depleted layer.

8. The Ni-based alloy pipe or tube for nuclear power according to claim 7, wherein a rate of corrosion evaluated in accordance with ASTM A 262 C is 1 mm/yr or lower.

9. The Ni-based alloy pipe or tube for nuclear power according to claim 6, wherein a rate of corrosion evaluated in accordance with ASTM A 262 C is 1 mm/yr or lower.

10. The Ni-based alloy pipe or tube for nuclear power according to claim 6, wherein the chemical composition includes one or two or more elements selected from the group consisting of, in mass %:

0.005 to 0.300% Ti;

0.001 to 0.200% Nb;

0.001 to 0.300% Ta; and not less than 0.001% and less than 0.03% Zr.

11. The Ni-based alloy pipe or tube for nuclear power according to claim 10, wherein a rate of corrosion evaluated in accordance with ASTM A 262 C is 1 mm/yr or lower.

12. The Ni-based alloy pipe or tube for nuclear power according to claim 10, wherein the grain-boundary precipitate particles includes both a carbonitride and $M_{23}C_6$, and has no Cr-depleted layer.

13. The Ni-based alloy pipe or tube for nuclear power according to claim 12, wherein a rate of corrosion evaluated in accordance with ASTM A 262 C is 1 mm/yr or lower.

* * * * *